US008002257B2

(12) United States Patent
Dawley et al.

(10) Patent No.: US 8,002,257 B2
(45) Date of Patent: Aug. 23, 2011

(54) WEB CONVERSION AND COLLATING APPARATUS AND METHOD

(75) Inventors: Douglas Joseph Dawley, Dover, NH (US); Kent Dirksen Kasper, Dover, NH (US); Daniel Matthew Perdue, Rochester, NH (US); Kyle Albert Sandahl, Dover, NH (US)

(73) Assignee: Goss International Americas, Inc., Durham, NH (US)

( * ) Notice: Subject to any disclaimer, the term of this patent is extended or adjusted under 35 U.S.C. 154(b) by 71 days.

(21) Appl. No.: 12/322,767

(22) Filed: Feb. 6, 2009

(65) Prior Publication Data

US 2010/0201058 A1 Aug. 12, 2010

(51) Int. Cl.
*B65H 39/02* (2006.01)

(52) U.S. Cl. ..... 270/52.17; 270/52.09; 270/52.12

(58) Field of Classification Search ..... 270/5.02, 270/5.03, 21.1, 52.09, 52.12, 52.17
See application file for complete search history.

(56) References Cited

U.S. PATENT DOCUMENTS

| | | | | |
|---|---|---|---|---|
| 2,019,658 | A | 11/1935 | Crafts | |
| 2,361,459 | A | 10/1944 | Corbin | |
| 2,395,950 | A | 3/1946 | Wolf | |
| 2,631,845 | A * | 3/1953 | Zuckerman | 270/5.02 |
| 3,623,722 | A | 11/1971 | Siongren et al. | |
| 3,717,249 | A | 2/1973 | Faley | |
| 3,889,939 | A | 6/1975 | Faltin | |
| 3,915,445 | A | 10/1975 | Duncan et al. | |
| 3,948,504 | A | 4/1976 | Woessner et al. | |
| 3,964,598 | A | 6/1976 | Alsop | |
| 4,026,537 | A * | 5/1977 | Harris | 270/14 |
| 4,034,973 | A * | 7/1977 | Hams | 493/2 |
| 4,050,686 | A * | 9/1977 | McCain et al. | 270/52.09 |
| 4,279,410 | A | 7/1981 | Bolza-Schuenemann | |
| 4,466,603 | A * | 8/1984 | Schnell | 270/58.33 |
| 4,533,132 | A | 8/1985 | Wangermann | |
| 4,534,552 | A | 8/1985 | Rahe | |
| 4,545,782 | A | 10/1985 | Niemiro et al. | |
| 4,593,893 | A * | 6/1986 | Suter | 270/52.12 |
| 4,729,282 | A | 3/1988 | Kasdorf | |
| 4,919,027 | A | 4/1990 | Littleton | |
| 5,014,975 | A | 5/1991 | Hamricke | |

(Continued)

OTHER PUBLICATIONS

Vits-Multicut HP Servo Drive Sheeter; http://www.vits.com/index_en.php?level=3&CatID=3.13.16.49&inhalt_id=47 (accessed Feb. 4, 2009).

(Continued)

*Primary Examiner* — Patrick Mackey
(74) *Attorney, Agent, or Firm* — Davidson, Davidson & Kappel LLC

(57) ABSTRACT

A web conversion and collating apparatus is provided. The web conversion and collating apparatus includes a cutting apparatus cutting a printed web into a first signature and a second signature, a transport conveyor for transporting the first signature and the second signature away from the cutting apparatus and a first diverter for diverting the first signature from the transport conveyor. The second signature passes by the first diverter on the transport conveyor. A first assembly receives the first signature from the first diverter and a second assembly downstream of the first assembly receives the second signature. A stack receiving conveyor downstream of the first assembly and the second assembly is also included. The stack receiving conveyor receives the first signature and the second signature and the first signature is stacked on the second signature on the stack receiving conveyor. A printing press and a method of producing and collating signatures are also provided.

21 Claims, 4 Drawing Sheets

U.S. PATENT DOCUMENTS

| | | | | |
|---|---|---|---|---|
| 5,080,338 | A | 1/1992 | Belanger et al. | |
| 5,098,075 | A * | 3/1992 | Lindblom | 270/52.14 |
| 5,176,371 | A | 1/1993 | Rau et al. | |
| 5,293,797 | A | 3/1994 | Spalding et al. | |
| 5,354,047 | A | 10/1994 | Chesnutt et al. | |
| 5,405,127 | A | 4/1995 | Welborn | |
| 5,439,206 | A | 8/1995 | Raasch et al. | |
| 5,522,586 | A | 6/1996 | Bennett et al. | |
| 5,538,242 | A | 7/1996 | Doucet | |
| 5,542,547 | A | 8/1996 | Ricciardi | |
| 5,707,054 | A * | 1/1998 | Loquet et al. | 270/6 |
| 6,062,372 | A | 5/2000 | Cote et al. | |
| 6,231,044 | B1 | 5/2001 | Neary et al. | |
| 6,341,773 | B1 * | 1/2002 | Aprato et al. | 271/9.13 |
| 6,360,640 | B1 | 3/2002 | Cote | |
| 6,439,562 | B1 * | 8/2002 | Cote et al. | 270/52.17 |
| 6,443,449 | B1 | 9/2002 | Takagi et al. | |
| 6,572,097 | B2 | 6/2003 | d'Agrella et al. | |
| 6,588,739 | B1 | 7/2003 | Weis | |
| 6,684,746 | B2 | 2/2004 | Hilliard et al. | |
| 7,621,857 | B2 * | 11/2009 | Pompile | 482/129 |
| 2001/0022421 | A1 | 9/2001 | Schaefer et al. | |
| 2004/0060464 | A1 | 4/2004 | Birkenfeld et al. | |
| 2004/0135303 | A1 * | 7/2004 | Weiler | 270/5.02 |
| 2005/0124481 | A1 | 6/2005 | D'Agrella et al. | |
| 2006/0144507 | A1 | 7/2006 | Herbert et al. | |
| 2006/0180438 | A1 | 8/2006 | Mosli et al. | |
| 2007/0062392 | A1 | 3/2007 | Ratz | |
| 2007/0068408 | A1 | 3/2007 | Christmann et al. | |
| 2008/0112743 | A1 | 5/2008 | Moore | |
| 2008/0128983 | A1 | 6/2008 | Prim et al. | |
| 2008/0190309 | A1 | 8/2008 | Rancourt et al. | |
| 2009/0127763 | A1 * | 5/2009 | Cossette | 270/21.1 |
| 2010/0201056 | A1 | 8/2010 | Dawley | |
| 2010/0201065 | A1 | 8/2010 | Dawley et al. | |
| 2010/0201066 | A1 | 8/2010 | Dawley | |

OTHER PUBLICATIONS

Vits Rotocut S; http://www.vits.com/index_en.php?level=3&CatID=3.13.16.49&inhalt_id=43 (accessed Feb. 4, 2009).

Vits Rotocut HS; http://www.vits.com/index_en.php?level=3&CatID=3.13.16.49&inhalt_id=44# (accessed Feb. 4, 2009).

Innotech High Speed Sheeters; http://www.innotechequip.com/sheeter.htm (accessed Feb. 4, 2009).

Innotech Finishing Line Equipment; http://www.innotechequip.com/finishing.htm (accessed Feb. 4, 2009).

Goss International; M-600 Folia: High Productivity Perfecting Press; 2008 (accessed from http://www.gossinternational.com/clientuploads/folia/downloads.htm, on Feb. 5, 2009).

Goss International; M-600: 16-Page Web Offset Press Systems; Aug. 5, 2008 (accessed from http://gossinternational.com/index.php?src=gendocs&ref=m600&category=en_Products, on Feb. 5, 2009).

Manroland; Roland 900: Printing Units, Dimensions and Details; http://www.manroland.com/com/pdf_en/MR_ROLAND_900_Datenblatt_e.pdf (accessed Feb. 5, 2009).

Manroland; Nothing Can Replace Capacity: The Roland 900; http://www.manroland.com/com/pdf_en/MR_ROLAND_900_Broschuere_e.pdf (accessed Feb. 5, 2009).

U.S.P.T.O. Office Action in U.S. Appl. No. 12/322,738 (Pub. 2010/0201065) dated Sep. 15, 2010.

U.S.P.T.O. Office Action in U.S. Appl. No. 12/322,768 (Pub. 2010/0201066) dated Sep. 15, 2010.

U.S.P.T.O. Office Action in U.S. Appl. No. 12/322,775 (Pub. 2010/0201056) dated Dec. 28, 2010.

* cited by examiner

WEB CONVERSION AND COLLATING APPARATUS AND METHOD

The present invention relates generally to printing presses and more particularly to web conversion and collating apparatuses in printing presses.

BACKGROUND OF INVENTION

Web-conversion machines are used in the printing industry to assist in converting webs into final printed products. For example, large combination folders may collect an amount of printed material to produce an intermediate product, a portion of a final printed product. To generate these intermediate products, ribbons may be cut, longitudinally folded, half-folded and quarter-folded.

A Goss PCF-3 may produce intermediate products, or signatures, of up to 96 pages. More typically, the Goss PCF-3 produces 32-page or 64-page signatures. The signatures will later be combined in a bindery to generate a final printed product.

Conventional folders may be limited in the thickness of intermediate products that the folders may produce. Also, folders generally may only produce intermediate products having a single cutoff.

U.S. Pat. No. 3,964,598 discloses a stacking mechanism and method that brings batches of articles from a shingled formation on a conveyor to a vertically stacked formation without stopping the progress of any of them. Shingled articles are pushed forward from behind by a pusher at a speed greater than that of a conveyor on which they are supported while at the same time a slower-moving obstruction is erected in their path offering a vertical rear wall. The articles successively align against the rear wall of the obstruction until when the longitudinal distance between the pusher and the obstruction has become substantially the same as the length of the articles, so that all of a batch of shingled articles must have been stacked, the obstruction is withdrawn and the stack is driven on by the pusher.

U.S. Pat. No. 4,533,132 discloses a collating and stitching machine to arrange into informative and significant order a plurality of part-product or sheets. The machine has at least two rotating sheet delivery drums, the axis of rotation of which extend substantially perpendicularly to the conveying direction of an endless conveyor. The endless conveyor transports the folded sheets during the collating thereof with their folded backs extending transversely to the conveying direction and with the folded backs leading the direction of movement. The conveyor inserts the sheets one into the other. At least one stitching head is arranged in the return area to the endless conveyor to stitch the sheets together and thereby form a booklet, a magazine or the like.

U.S. Pat. No. 5,041,975 discloses a signature delivery apparatus including a mechanism for diverting signatures into a first series of serially arranged dual conveyors or a second series of serially arranged conveyors. Each of the series of serially arranged conveyors are substantially identical in construction. The first series includes an assembly of opposed conveyor belts which engage the leading edge of each signature and reduces the speed of the signatures. Subsequently, the signature passes into an adjacent series of opposed conveyor belts where the signature is overlapped with the next succeeding signature and the speed of the signatures is reduced further.

BRIEF SUMMARY OF THE INVENTION

A web conversion and collating apparatus is provided. The web conversion and collating apparatus includes a cutting apparatus cutting a printed web into a first signature and a second signature, a transport conveyor transporting the first signature and the second signature away from the cutting apparatus and a first diverter diverting the first signature from the transport conveyor. The second signature passes by the first diverter on the transport conveyor. A first assembly receives the first signature from the first diverter and a second assembly downstream of the first assembly receives the second signature. A stack receiving conveyor downstream of the first assembly and the second assembly is also included. The stack receiving conveyor receives the first signature and the second signature and the first signature is stacked on the second signature on the stack receiving conveyor.

A printing press is also provided. The printing press includes a printing unit printing an image on a web, a slitter slitting the web into at least two ribbons, a former longitudinally folding the at least two ribbons and a cutting apparatus cutting the at least two ribbons so that the image is cut into a first signature and a second signature. A transport conveyor transports the first signature and the second signature away from the cutting apparatus and a first diverter diverts the first signature from the transport conveyor. The second signature passes by the first diverter on the transport conveyor. A first assembly receives the first signature from the first diverter and a second assembly downstream of the first assembly receives the second signature. A stack receiving conveyor downstream of the first assembly and the second assembly is also included. The stack receiving conveyor receives the first signature and the second signature and the first signature is stacked on the second signature on the stack receiving conveyor.

A method of producing and collating signatures is also provided. The method includes the steps of cutting a printed web with a cutting apparatus to create a first signature and a second signature, transporting the first signature and the second signature away from the cutting apparatus with a transport conveyor, diverting the first signature from the transport conveyor with a first diverter to a first assembly, transporting the second signature past the first diverter to a second assembly and delivering the first signature and the second signature to a stack receiving conveyor such that the first signature is stacked upon the second signature.

BRIEF DESCRIPTION OF THE DRAWINGS

The present invention is described below by reference to the following drawings, in which.

DETAILED DESCRIPTION

Figure 1:
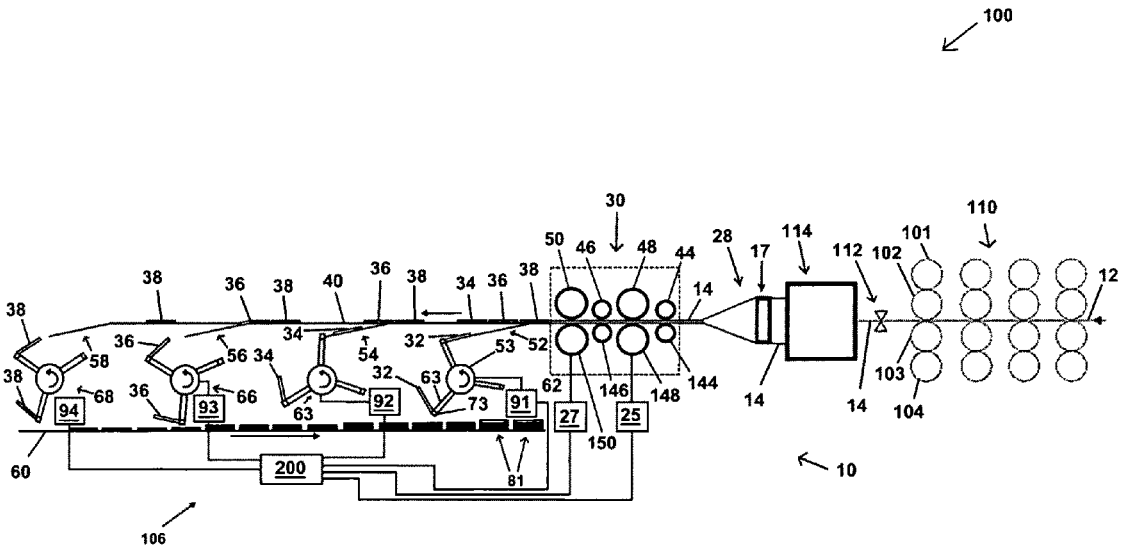
FIG. 1 shows a schematic side view of a printing press including a web conversion and collating apparatus according to an embodiment of the present invention.

FIG. 1 shows a schematic side view of a printing press 100 including a web-conversion apparatus 10 according to an embodiment of the present invention. Printing units 110, each including an upper plate cylinder 101, an upper blanket cylinder 102, a lower blanket cylinder 103 and a lower plate cylinder 104, act together to print four color images on a web 12. The term image used herein includes text, graphics or printed indicia on web 12, with each image having a length equal to a circumferential printing length of each plate cylinder 101, 104 and including contents of a number of pages of final printed products produced by printing press 100. After images are printed on web 12, web 12 passes through a slitter 112, which longitudinally slits web 12 into a plurality of ribbons 14. A ribbon guiding section 114 may then turn and offset ribbons 14 so ribbons 14 are vertically aligned and traveling in a horizontal plane as ribbons 14 pass through vertically aligned nip rolls 17 and enter a former 28. Former 28 imparts a longitudinal fold upon ribbons 14 such that ribbons 14 are horizontally aligned and traveling substantially in the same horizontal plane as ribbons exit former 28. Ribbons 14 may also be slit over former 28 to yield twice as many unfolded ribbons 14. Web 12 and ribbons 14 may travel at a velocity V1.

Once longitudinally folded, ribbons 14 are cut by a cutting assembly 30 into successive intermediate printed products or signatures 32, 34, 36, 38, with each signature 32, 34, 36, 38 being the same length. Cutting assembly 30 includes cut cylinders 48, 50 interacting with respective anvil cylinders 148, 150 to create signatures 32, 34, 36, 38. Cut cylinder 48 may include one or more knives that are segmented and partially cut, or perforate, ribbons 14 by contacting anvils on anvil cylinder 148. Cut cylinder 50 may include knives that finish the partial cuts created by knives of cut cylinder 48, forming signatures 32, 34, 36, 38, by contacting anvils on anvil cylinder 150. Knives on cut cylinder 50 may also be segmented. Cutting assembly 30 may include a first pair of nip rollers 44, 144, and a second pair of nip rollers 46, 146. Nip rollers 44, 144, 46, 146 deliver ribbons 14 to cut cylinder 48 where knife blades perforate ribbons 42 with a first cut. The process of partially cutting ribbons with cut cylinder 48 and finishing the cut with cut cylinder 50 may be referred to as a double cut. In another embodiment, ribbons 14 may also be cut completely by cut cylinder 50 and anvil cylinder 150, making the perforation by cut cylinder 48 and anvil cylinder 148 unnecessary.

In this embodiment, printing units 110 print successive four-color images on both sides of web 12, each image being aligned with an image on the opposite side of web 12. Each image includes the contents of 32 pages of final printed products produced from the image, so that a length of web 12 with an image on both sides includes the contents of 64 pages of the final printed products. Cutting assembly 40 forms four individual signatures 32, 34, 36, 38 from each image printed on web 12 by printing units 110, with each signature including 16 pages (8 pages, printed on both front and back). For example, ribbons 14 are cut by cutting assembly 30 such that one cut by cut cylinder 50 creates a lead edge of one first signature 32, a subsequent by cut cylinder 50 creates a lead edge of one second signature 34 and a tail edge of the one first signature 32, a subsequent by cut cylinder 50 creates a lead edge of one third signature 36 and a tail edge of the one second signature 34, a subsequent by cut cylinder 50 creates a lead edge of one fourth signature 38 and a tail edge of the one third signature 36 and a subsequent by cut cylinder 50 creates a lead edge of one subsequent first signature 32 and a tail edge of the one fourth signature 38. In the embodiment where a double cut is performed, each cut by cut cylinder 50 creating edges of signatures finishes a partial cut created by cut cylinder 48. In the embodiment where only cut cylinder 50 is provided, and not cut cylinder 48, each cut by cut cylinder 50 cuts entirely through ribbons 14.

Cylinders 48, 148 are phased with respect to cylinders 50, 150 so that printed signatures 32, 34, 36, 38 are the same length. Cylinders 48, 148 may be driven by a servomotor 25 at varying velocities during each revolution and cylinders 50, 150 may be driven by a servomotor 27 at varying velocities during each revolution. Servomotors 25, 27 may be controlled by a controller 200.

Signatures 32, 34, 36, 38, traveling away from cutting assembly 30 enter a collating and delivery section 106 where conveyor 40 transports signatures 32, 34, 36, 38 at a second velocity V2 away from cutting assembly 30. Velocity V2 may be greater than velocity V1. Conveyor 40 may be in the form of transport tapes, which grip a lead edge of ribbons 13 just as ribbons 14 are cut by cut cylinder 50 and positively grip signatures 32, 34, 36, 38 by contacting signatures 32, 34, 36, 38 from above and below. Guide belts may be provided to assist in guiding ribbons 14 into cutting assembly and signatures 32, 34, 36, 38 towards conveyor 40. The guide belts may be provided in circumferential cutouts spaced axially in cylinders 48, 50, 148, 150 and rolls 44, 46, 144, 146. In an alternative embodiment, the guide belts may be introduced only between cut cylinder 48 and cut cylinder 50 to control the printed product while the uncut portions of ribbons 14 are cut by cut cylinder 50. Conveyor 40 passes above deceleration assemblies 62, 64, 66, 68. Signatures 32, 34, 36, 38 are diverted to separate deceleration assemblies 62, 64, 66, 68, respectively, which stack signatures 32, 34, 36, 38 in an appropriate order to form product stacks 81.

Signatures 32, 34, 36, 38 are diverted from conveyor 40 by respective diverter assemblies 52, 54, 56, 58. Diverter assemblies 52, 54, 56, 58 force respective signatures 32, 34, 36, 38 out of the path of conveyor 40 and down to respective deceleration assemblies 62, 64, 66, 68.

A first diverter assembly 52 removes signatures 32 from conveyor 40 and transports signatures 32 to a first deceleration assembly 62. Signatures 34 are transported by conveyor 40 past first diverter assembly 52 and to a second diverter assembly 54, which removes signatures 34 from conveyor 40 and transports signatures 34 to a second deceleration assembly 64. Signatures 36 are transported by conveyor 40 past diverter assemblies 52, 54 and to a third diverter assembly 56, which removes signatures 36 from conveyor 40 and transports signatures 36 to a third deceleration assembly 66. Signatures 38 are transported by conveyor 40 past diverter assemblies 52, 54, 56 and to a fourth diverter assembly 58, which removes signatures 38 from conveyor 40 and transports signatures 38 to a fourth deceleration assembly 68. In an alternative embodiment, fourth diverter assembly 58 is not necessary, as conveyor 40 transports signatures 38 directly to fourth deceleration assembly 68.

Fourth deceleration assembly 68, rotating about an axis that is perpendicular to the direction of travel of conveyor 40, enter a collating and delivery section 106, receives each signature 38 one-by-one and passes signatures 38 to a collating conveyor 60. Collating conveyor 60 is traveling at a velocity V3, which may be less than velocity V2, in a second horizontal plane below the horizontal plane of conveyor 40. Collating conveyor 60, in this embodiment, is traveling below deceleration assemblies 62, 64, 66, 68 in a horizontal direction that is opposite the horizontal direction that conveyor 40 transports signatures 32, 34, 36, 38, and is tangential to the paths of rotation of deceleration assemblies 62, 64, 66, 68. Third deceleration assembly 66, operating in a manner similar to fourth deceleration assembly 68, receives signatures 36 one-by-one and places each signature 36 on top of one signature 38 on conveyor 60. Second deceleration assembly 64, operating in a manner similar to deceleration assemblies 66, 68, receives signatures 34 one-by-one and places each signature 34 on top of one signature 36, which is stacked on one signature 38, on conveyor 60. First deceleration assembly 62, operating in a manner similar to deceleration assemblies 64, 66, 68, receives signatures 32 one-by-one and places each signature 32 on top of one signature 34, which is stacked on one signatures 36 and one signature 38, on conveyor 60.

Once signature 32 is stacked upon signatures 34, 36, 38, a final product stack 81 is formed. Final product stack 81 is delivered by conveyor 60 for finishing operations to create a final printed product. Final product stack 81, in this embodiment, is a sixty-four page book because four ribbons 14 were longitudinally folded, cut into four 16-page signatures 32, 34, 36, 38 and signatures 32, 34, 36, 38 were stacked on top of one another. In alternative embodiments, web 12 may be slit into a different number of ribbons and/or two or more webs can be provided to vary the number of pages in a final product produced by the present invention.

For example, assume printing press 100 includes plate cylinders 101, 104 having a printing circumference of 44" and a printing width of 68" prints images having a 44" length and a 68" width. A single web 12 slit into four 17-inch wide ribbons, which are folded longitudinally in half and cut into four 11" long signatures can deliver a 64-page, 8.5"×11" book. A second printing unit with a second slitter may be provided and a second web may be introduced. If web 12 and the second web are slit into four 17-inch wide ribbons, which are folded longitudinally in half and cut into four 11" long signatures, a 128-page, 8.5"×11" book may be created. A single web slit into six ribbons and cut into six approximately 7.33" long signatures can create a 144-page, 5.5"×7.33" book. Two webs slit into six ribbons and cut into six approximately 7.33" long signatures can create a 288-page, 5.5"×7.33" book.

Each deceleration assembly 62, 64, 66, 68 may include a center body 53, arms 63 and grippers 73. Arms 63 protrude radially from center bodies 53 and grippers 73 configured to engage signatures 32, 34, 36, 38 are positioned at ends of arms 63.

Figure 2:
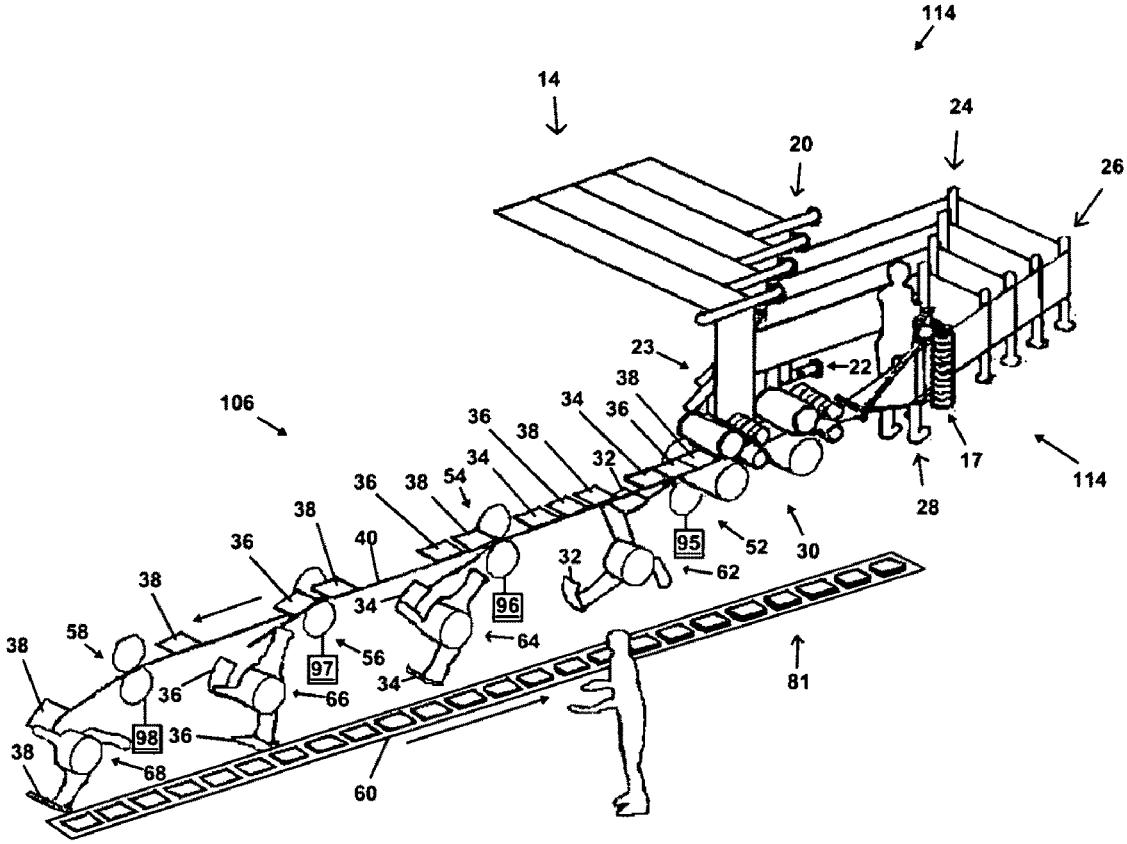
FIG. 2 shows a perspective view of the web conversion and collating apparatus shown in FIG. 1.

Diverting assemblies 52, 54, 56, 58 and deceleration assemblies 62, 64, 66, 68 are phased so that diverting assemblies remove respective signatures 32, 34, 36, 38 from conveyor 40 in a proper orientation and arms 63 of deceleration assemblies 62, 64, 66, 68 are in proper positions to receives signatures 32, 34, 36, 38 from diverting assemblies 52, 54, 56, 58, respectively, and properly stack signatures 32, 34, 36, 38 on conveyor 60. Deceleration assemblies 62, 64, 66, 68 may be driven by respective motors 91, 92, 93, 94, and diverting assemblies may be driven by respective motors 95, 96, 97, 98 (FIG. 2). Motors 91, 92, 93, 94, 95, 96, 97, 98 may be servomotors and may be controlled by controller 200 to ensure proper phasing.

Hoppers may be provided before each deceleration assembly 62, 64, 66, 68 to add inserts to signatures 32, 34, 36, 38.

In alternative embodiments, cutting assembly 30 may be configured to cut each image into a different number of signatures, or if the printing circumferences of plate cylinders 101, 104 are varied, phasing of cylinders 48, 50, 148, 150 may be varied accordingly. The number of delivery assemblies, deceleration assemblies and delivery sections may be adjusted to match the maximum number of signatures produced by cutting assembly 30. Web conversion apparatus 10 may be adjusted to accommodate three signatures from one image, for example, by inactivating diverting assembly 58 and deceleration assembly 68 and rephrasing diverting assemblies 52, 54, 56 and deceleration assemblies 62, 64, 66.

Advantageously, intermediate printed products or signatures 32, 34, 36, 38 produced by apparatus 10 may only be longitudinally folded and not half-folded or quarter-folded. Minimizing folding may reduce product defects associated with the multiple fold processes, such as fan-out, which may result from folding thicker signatures, or print-to-fold errors. Signatures may be caused to accelerate, decelerate or change directions during half-folding and quarter-folding, and thus may lead to dog-ears, z-folds or other defects in the intermediate products and limit the speed that intermediate products may be produced. Avoiding half-folding and quarter-folding also may eliminate trimming of folded edges, including the machinery, labor and waste that accompanies such operations.

FIG. 2 shows a perspective view of web conversion and collating apparatus 10 from FIG. 1. Web conversion and collating apparatus 10 includes ribbon guiding section 114, cutting assembly 30, former 28 and collating and delivery section 106. Ribbons 14 enter web-conversion apparatus 10 and are converted into multiple signatures 32, 34, 36, 38, which may form individual final printed products.

Figure 3:
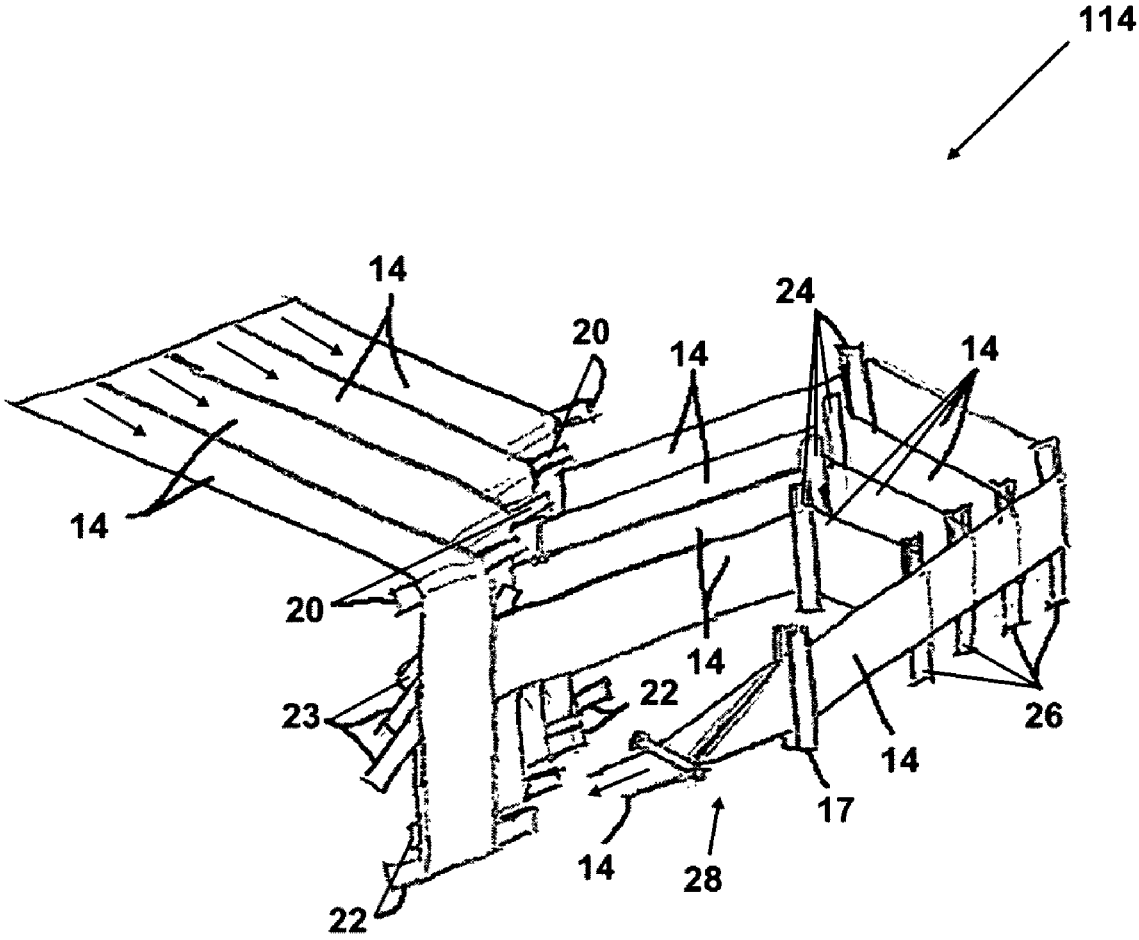
FIG. 3 shows an enlarged perspective view of a ribbon guiding section of the web-conversion apparatus shown in FIG. 2.

Ribbon guiding section 114, which is shown more clearly in FIG. 3, includes lead rolls 20, 24, compensators 22, angle bars 23 and pull rolls 26. Ribbons 14 are wrapped around and redirected by lead rolls 20, 24 compensators 22, angle bars 23 and pull rolls 26 to ensure ribbons 14 are properly oriented as they enter former 28. Ribbons 14 enter ribbon guiding section 114 traveling substantially horizontal and are guided vertically by lead rolls 20 and compensators 22. Angle bars 23 redirect ribbons 14 so that ribbons 14 are transported horizontally, in an upright on-edge orientation, such that ribbons are aligned as required vertically. Lead rolls 24 and pull rolls 26 reverse the horizontal direction of travel of ribbons 14, while maintaining the upright on-edge orientation of ribbons 14. The axes of rotation of lead rolls 24, pull rolls 26, and nip rolls 17 are aligned with the vertical direction, allowing ribbons 14 to be transported horizontally into former 28. Ribbons 14 are merged on-edge after pull rolls 26. Ribbons 14 then pass between nip rolls 17 and are longitudinally folded by former 28.

Ribbons 14, once longitudinally folded, are aligned with the horizontal direction so that ribbons 14 are no longer oriented on-edge but instead are aligned substantially in the horizontal plane. Ribbons 14 are then cut by a cutting assembly 30 into four successive signatures 32, 34, 36, 38. Cylinders 48, 50, 148, 150 of cutting assembly 30 are rotated at appropriate frequencies so that knives on cut cylinders 48, 50 create signatures 32, 34, 36, 38 having desired lengths. Signatures 32, 34, 36, 38, having a horizontal orientation, are transported in the horizontal direction to respective diverting assemblies 52, 54, 56, 58, which alter the path of signatures and pass signatures 32, 34, 36, 38 to respective deceleration assemblies 62, 64, 66, 68, located below conveyor 40. Deceleration assemblies 62, 64, 66, 68, rotating about axes that are perpendicular to the horizontal direction that conveyor 40 transports signatures 32, 34, 36, 38, grip respective signatures 32, 34, 36, 38, and rotate signatures 32, 34, 36, 38 approximately 180 degrees with respect to the axes of deceleration assemblies 62, 64, 66, 68, respectively. Deceleration assemblies 62, 64, 66, 68 then release signatures 32, 34, 36, 38, now traveling in the direction opposite the transport direction of conveyor 40, to conveyor 60, which may carry signatures 32, 34, 36, 38, stacked as desired, away from respective deceleration assemblies 62, 64, 66, 68 in a direction that is tangential to the rotational paths of deceleration assemblies 62, 64, 66, 68.

By transporting ribbons 14, and signatures 32, 34, 36, 38 primarily in the horizontal direction, the height of web conversion and delivery apparatus 10 is advantageously reduced. The reduced height may lower the ceiling height requirements of printing press facilities and decrease the need for press personnel to climb stairs to reach the various apparatus components. Since web conversion and delivery apparatus 10 can be operated from one level, web conversion and delivery apparatus 10 may thus be easier to operate. In the embodiment shown in FIGS. 1 and 2, web conversion and delivery apparatus 10 may be 38 feet long and 8 feet high. In another embodiment, a web conversion and delivery apparatus may be 54 feet long and 8 feet high and receive eight ribbons and create and deliver six different signatures.

In other embodiments, a second web may be printed by a second set of printing units, slit into ribbons by a second slitter and combined with ribbons 14 to create a ribbon bundle with an increased number of ribbons, which may be converted into signatures having an increased number of pages. Also, more or less than four ribbons 14 could be created by slitter 112 (FIG. 1) and delivered by ribbon guiding section 114.

Figure 4:
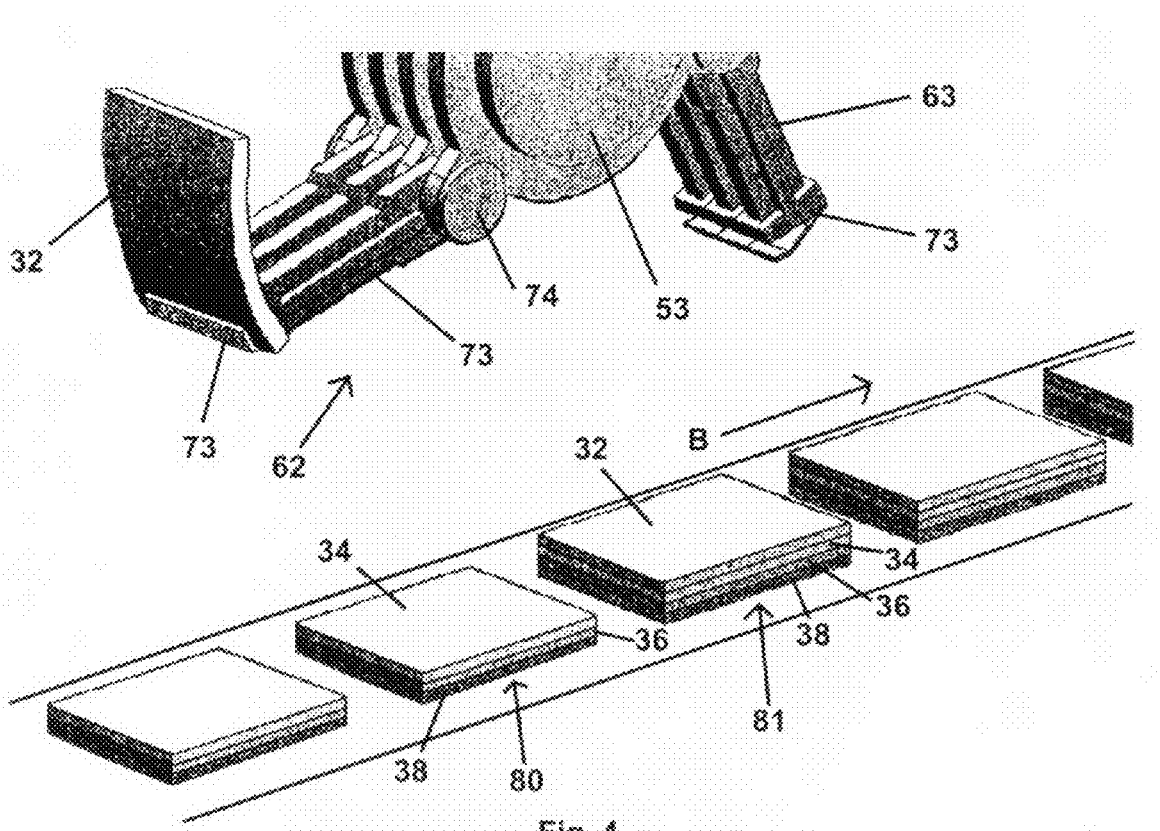
FIG. 4 shows an enlarged view of a deceleration assembly shown in FIGS. 1 and 2 delivering a printed product to form a final printed product.

FIG. 4 shows an enlarged view of deceleration assembly 62 shown in FIGS. 1 and 2 delivering signature 32 to form final product stack 81. Deceleration assembly 62 includes center body 53, arms 63 and grippers 73. Arms 63 are connected to 53 center body 53 by connectors 74. Grippers 73 engage signatures 32 and deliver signatures 32 to conveyor 60, which is traveling in direction B. Grippers 73 may clamp products to prevent signatures 32 from slipping out of grippers 73 or so the alignment of signatures 32 is not impaired. As deceleration assembly 62 is rotated counterclockwise about an axis of center body 53, arms 73 pass by conveyor 60 and grippers 73 release signatures 32 on top of partial products 80. Arms 63 may be actuated about connectors 53 to ensure that grippers 73 are in appropriate positions to receive and release signatures 32.

Each partial product stack 80 includes signature 38 resting on conveyor 60, signature 36 stacked upon signature 38 and signature 34 stacked upon signature 36. Once signature 32 is stacked upon signature 34, final product stack 81 is formed. Deceleration assemblies 64, 66, 68 are configured similar to deceleration assembly 62 and transport signatures 34, 36, 36, respectively, in a manner similar to how deceleration assembly 62 transports signatures 32.

In the preceding specification, the invention has been described with reference to specific exemplary embodiments and examples thereof. It will, however, be evident that various modifications and changes may be made thereto without departing from the broader spirit and scope of invention as set forth in the claims that follow. The specification and drawings are accordingly to be regarded in an illustrative manner rather than a restrictive sense.

What is claimed is:

1. A web conversion and collating apparatus comprising:

a cutting apparatus cutting a printed web into a first signature and a second signature;

a transport conveyor for transporting the first signature and the second signature away from the cutting apparatus;

a first diverter for selectively diverting signatures from the transport conveyor, the first signature being diverted from the transport conveyor by the first diverter, the second signature not being diverted from the transport conveyor by the first diverter;

a first assembly receiving the first signature from the first diverter;

a second assembly downstream of the first assembly receiving the second signature; and a stack receiving conveyor downstream of the first assembly and the second assembly, the stack receiving conveyor receiving the first signature from the first assembly and the second signature from the second assembly, the first signature being stacked on the second signature on the stack receiving conveyor.

2. The web conversion and collating apparatus recited in claim 1 further comprising a second diverter downstream from the first diverting assembly for selectively diverting signatures from the transport conveyor, the second signature being diverted from the transport conveyor to the second assembly by the second diverter.

3. The web conversion and collating apparatus recited in claim 2 further comprising a third diverter for selectively diverting signatures downstream from the second diverter, a third assembly downstream from the second assembly and a fourth assembly downstream from the third assembly, the cutting apparatus cutting the printed web into the first signature, the second signature, a third signature and a fourth signature, the transport conveyor arranged to transport the third signature and the fourth signature away from the cutting apparatus, the third diverter arranged for diverting the third signature from the transport conveyor to the third assembly, the fourth assembly arranged to receive the fourth signature from the transport conveyor, the stack receiving conveyor arranged to receive the third signature and the fourth signature, the third signature being stacked on the fourth signature and the second signature being stacked on the third signature on the stack receiving conveyor.

4. The web conversion and collating apparatus recited in claim 3 further comprising a fourth diverter for selectively diverting signatures from the transport conveyor, the fourth signature being diverted from the transport conveyor to the fourth assembly by the fourth diverter.

5. The web conversion and collating apparatus recited in claim 3 wherein the first assembly, the second assembly, the third assembly and the fourth assembly are deceleration assemblies that decelerate the respective first, second, third and fourth signatures.

6. The web conversion and collating apparatus recited in claim 1 wherein both the transport conveyor and the stack receiving conveyor transport the first and second signatures horizontally and the transport conveyor is located above the stack receiving conveyor.

7. The printing press recited in claim 6 wherein the first diverter forces the first signature downward to the first assembly.

8. A printing press comprising:

a printing unit for printing an image on a web;

a slitter for slitting the web into at least two ribbons;

a former for longitudinally folding the at least two ribbons;

a cutting apparatus for cutting the at least two ribbons so that the image is cut into a first signature and a second signature;

a transport conveyor for transporting the first signature and the second signature away from the cutting apparatus;

a first diverter for selectively diverting signatures from the transport conveyor, the first signature being diverted from the transport conveyor by the first diverter, the second signature not being diverted from the transport conveyor by the first diverter;

a first assembly for receiving the first signature from the first diverter;

a second assembly downstream of the first assembly for receiving the second signature; and a stack receiving conveyor downstream of the first assembly and the second assembly for receiving the first signature and the second signature, the first signature being stacked on the second signature on the stack receiving conveyor.

9. The printing press recited in claim 8 wherein the transport conveyor transports the signatures horizontally and the first assembly is a first rotating assembly located below the transport conveyor.

10. The printing press recited in claim 9 wherein the first diverter forces the first signature downward to the first rotating assembly.

11. A method of producing and collating signatures comprising:

cutting a printed web with a cutting apparatus to create a first signature and a second signature;

transporting the first signature and the second signature away from the cutting apparatus with a transport conveyor;

diverting the first signature from the transport conveyor with a first diverter to a first assembly;

transporting the second signature past the first diverter to a second assembly; and delivering the first signature and the second signature to a stack receiving conveyor such that the first signature is stacked upon the second signature.

12. The method recited in claim 11 wherein the cutting step further includes cutting the printed web with the cutting apparatus to create a third signature and a fourth signature.

13. The method recited in claim 12 wherein the step of transporting the second signature past the first diverter to the second assembly includes diverting the second signature from the transport conveyor with a second diverter to a second assembly.

14. The method recited in claim 13 further comprising:

transporting the third signature past the second diverter;

diverting the third signature from the transport conveyor with a third diverter to a third assembly;

transporting the fourth signature past the third diverter to a fourth assembly; and delivering the third signature and the fourth signature to the stack receiving conveyor such that the third signature is stacked upon the fourth signature and the second signature is stacked upon the third signature.

15. The method recited in claim 11 wherein the step of transporting the first signature and the second signature away from the cutting apparatus is performed by horizontally transporting the first signature and the second signature.

16. The method recited in claim 15 wherein the step of diverting moves the first signature downward to the first assembly.

17. The method recited in claim 16 wherein the delivering step includes moving the second signature downward rotationally with the second assembly and moving the first signature downward rotationally with the first assembly to stack the first signature upon the second signature on the stack receiving conveyor.

18. The method recited in claim 17 further comprising transporting the first signature and second signature horizontally away from the first assembly and the second assembly.

19. The method recited in claim 12 wherein the cutting step further includes severing the web at a first position to create a lead edge of the first signature, severing the web at a second position to create a lead edge of the second signature and a tail edge of the first signature, severing the web at a third position to create a lead edge of the third signature and a tail edge of the second signature, severing the web at a fourth position to create a lead edge of the fourth signature and a tail edge of the third signature and severing the web at a fifth position to create a tail edge of the fourth signature.

20. The web conversion and collating apparatus recited in claim 1 wherein the transport conveyor is aligned above the stack receiving conveyor.

21. The web conversion and collating apparatus recited in claim 1 wherein stack receiving conveyor transports the signatures in a direction opposite the transport conveyor.

* * * * *